US011779832B2

(12) United States Patent
Gomez

(10) Patent No.: US 11,779,832 B2
(45) Date of Patent: Oct. 10, 2023

(54) BILLIARD TRAINING DEVICE TO CONTROL THE CUE BALL AFTER IMPACTING A TARGET BALL

(71) Applicant: Eduardo Roberto Gomez, Plantation, FL (US)

(72) Inventor: Eduardo Roberto Gomez, Plantation, FL (US)

( * ) Notice: Subject to any disclaimer, the term of this patent is extended or adjusted under 35 U.S.C. 154(b) by 0 days.

(21) Appl. No.: 17/293,686

(22) PCT Filed: Nov. 13, 2018

(86) PCT No.: PCT/US2018/060638
§ 371 (c)(1),
(2) Date: May 13, 2021

(87) PCT Pub. No.: WO2020/101647
PCT Pub. Date: May 22, 2020

(65) Prior Publication Data

US 2022/0016513 A1 Jan. 20, 2022

(51) Int. Cl.
*A63D 15/00* (2006.01)
*A63D 15/10* (2006.01)

(52) U.S. Cl.
CPC ..... *A63D 15/105* (2013.01); *A63D 15/006* (2013.01)

(58) Field of Classification Search
CPC ..... A63D 15/105; A63D 15/006
(Continued)

(56) References Cited

U.S. PATENT DOCUMENTS 3,411,779 A 11/1968 McGowan
3,711,091 A * 1/1973 Dixon ..... A63D 15/006 473/2

(Continued)

FOREIGN PATENT DOCUMENTS

CN 2445779 5/2001
CN 2445779 Y 5/2001

(Continued)

OTHER PUBLICATIONS

International Search Report and Written Opinion for PCT/US2018/048299 of the U.S Patent and Trademark Office dated Nov. 7, 2018, 15 pp.

(Continued)

*Primary Examiner* — Mitra Aryanpour
(74) *Attorney, Agent, or Firm* — Edwin S. Flores; Chalker Flores, LLP

(57) ABSTRACT

This invention relates to a device for playing billiards or pool. The device allows having control over the cue ball after impacting the target ball what is generally called English. The invention presents different stackable layers that enable the player to perform the following billiard shots: a) two Draw Shots, b) one Stop Shot, c) one Stun Shot and d) two Follow Shots. The stackable layers connect to each other by magnets and securing knobs, and the device contains in the bottom layer a sliding panel to always place the cue ball in the center of the concave groove of the device. In addition, the device has a multiple rail spins labeled at its top layer guiding the player shooting the cue ball in different directions. In another embodiment the device contains a sole piece including a sliding panel to place the cue ball in the center of the concave groove of the device and multiple rail spins labeled at its top.

16 Claims, 16 Drawing Sheets

(58) Field of Classification Search
USPC ..... 473/2, 42, 43
See application file for complete search history.

(56) References Cited

U.S. PATENT DOCUMENTS

| | | | | | |
|---|---|---|---|---|---|
| 4,053,153 | A | | 10/1977 | Josenhans | |
| 4,147,346 | A | | 4/1979 | Giannetti | |
| 4,151,990 | A | | 5/1979 | Josenhans | |
| 4,178,694 | A | | 12/1979 | Bonney et al. | |
| 4,268,033 | A | * | 5/1981 | Fontaine | A63D 15/006 473/2 |
| 4,461,043 | A | | 7/1984 | Lomedico | |
| 4,877,242 | A | | 10/1989 | James | |
| 5,003,637 | A | | 4/1991 | Lonon | |
| 5,238,457 | A | | 8/1993 | Triplett | |
| 5,322,475 | A | | 6/1994 | Irvin | |
| 5,597,360 | A | | 1/1997 | Freedenberg | |
| 5,769,728 | A | * | 6/1998 | Kasino | A63D 15/006 473/2 |
| 5,853,333 | A | | 12/1998 | Patterson | |
| 5,954,589 | A | * | 9/1999 | Masters | A63D 15/10 473/42 |
| 6,042,481 | A | | 3/2000 | Walker et al. | |
| 6,402,628 | B1 | | 6/2002 | Neil | |
| 6,929,555 | B2 | | 8/2005 | Morton | |
| 7,303,483 | B2 | * | 12/2007 | Black | A63D 15/006 473/2 |
| 8,523,693 | B2 | | 9/2013 | Nelson | |
| 8,870,669 | B1 | | 10/2014 | Griffen et al. | |
| 9,067,126 | B2 | | 6/2015 | Lucero | |
| 9,539,492 | B1 | * | 1/2017 | Eager | A63D 15/006 473/2 |
| 10,245,501 | B2 | | 4/2019 | Klimeck | |
| 2004/0031120 | A1 | | 12/2004 | Cherian | |
| 2007/0079421 | A1 | | 4/2007 | Davis | |
| 2007/0219008 | A1 | | 9/2007 | Deakes | |
| 2008/0125233 | A1 | * | 5/2008 | Tucker | A63D 15/006 473/2 |
| 2009/0258718 | A1 | * | 10/2009 | Cyr | A63D 15/006 473/1 |
| 2010/0314427 | A1 | | 12/2010 | Cartwright | |
| 2022/0016513 | A1 | * | 1/2022 | Gomez | A63D 15/105 473/2 |
| 2022/0072411 | A1 | | 3/2022 | Bragg | |

FOREIGN PATENT DOCUMENTS

| | | | | | |
|---|---|---|---|---|---|
| GB | 2152390 | A | | 2/1984 | |
| GB | 2196867 | A | | 5/1988 | |
| GB | 2224945 | A | * | 5/1990 | A63D 15/006 |
| GB | 2348149 | A | * | 9/2000 | A63D 15/006 |
| GB | 2578130 | A | * | 4/2020 | A63D 15/006 |
| WO | 2020046277 | A1 | | 3/2020 | |
| WO | 2020046279 | A1 | | 3/2020 | |
| WO | 2020101647 | A1 | | 5/2020 | |

OTHER PUBLICATIONS

IInternational Search Report and Written Opinion for PCT/US2018/048293 of the U.S. Patent and Trademark Office dated Dec. 20, 2018, 11 pp.

International Search Report and Written Opinion for PCT/US2018/060638 of the U.S Patent and Trademark Office dated Feb. 19, 2019, 12 pp.

"Billiard Ball" Sep. 11, 2018, https://en.wikipedia.org/wiki/Billiard_ball, accessed May 12, 2021, 8 pp.

* cited by examiner

Full Points of Contact and and Miscues Displayed

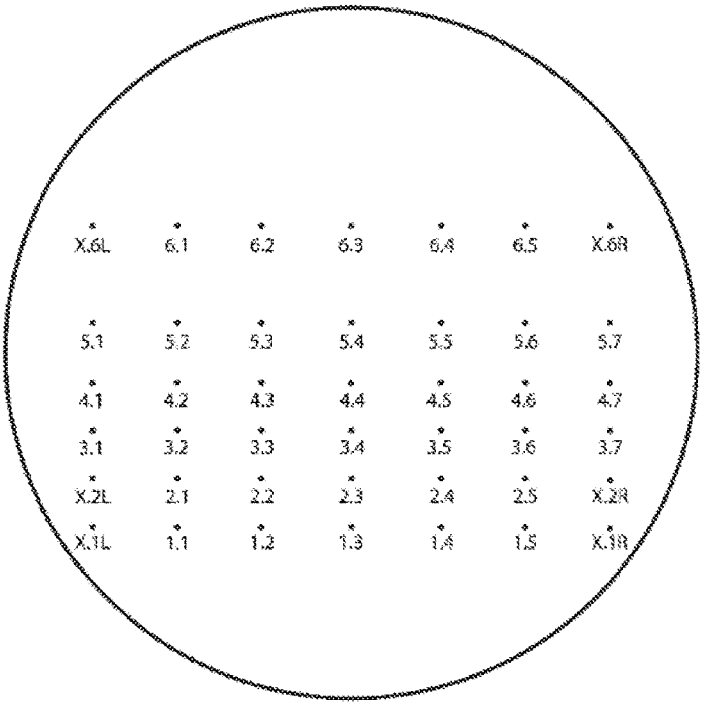

SHOTS REFERENCES ON THE CUE BALL 1.1. DRAW SHOT HARD, RAIL NO. 2 LEFT SPIN.
1.2. DRAW SHOT HARD, RAIL NO. 1 LEFT SPIN.
1.3. DRAW SHOT HARD, CENTER.
1.4. DRAW SHOT HARD, RAIL NO. 1 RIGHT SPIN.
1.5. DRAW SHOT HARD, RAIL NO. 2 RIGHT SPIN.

2.1. DRAW SHOT SOFT, RAIL NO. 2 LEFT SPIN.
2.2. DRAW SHOT SOFT, RAIL NO. 1 LEFT SPIN.
2.3. DRAW SHOT SOFT, CENTER.
2.4. DRAW SHOT SOFT, RAIL NO. 1 RIGHT SPIN.
2.5. DRAW SHOT SOFT, RAIL NO. 2 RIGHT SPIN.

3.1. STOP SHOT RAIL NO. 3 LEFT SPIN.
3.2. STOP SHOT RAIL NO. 2 LEFT SPIN.
3.3. STOP SHOT RAIL NO. 1 LEFT SPIN.
3.4. STOP SHOT, CENTER.
3.5. STOP SHOT RAIL NO. 1 RIGHT SPIN.
3.6. STOP SHOT RAIL NO. 2 RIGHT SPIN.
3.7. STOP SHOT RAIL NO. 3 RIGHT SPIN.

4.1. STUN SHOT RAIL NO. 3 LEFT SPIN.
4.2. STUN SHOT RAIL NO. 2 LEFT SPIN.
4.3. STUN SHOT RAIL NO. 1 LEFT SPIN.
4.4. STUN SHOT, CENTER.
4.5. STUN SHOT RAIL NO. 1 RIGHT SPIN.
4.6. STUN SHOT RAIL NO. 2 RIGHT SPIN.
4.7. STUN SHOT RAIL NO. 3 RIGHT SPIN.

5.1. FOLLOW SHOT SOFT, RAIL NO. 3 LEFT SPIN
5.2. FOLLOW SHOT SOFT, RAIL NO. 2 LEFT SPIN.
5.3. FOLLOW SHOT SOFT, RAIL NO. 1 LEFT SPIN.
5.3. FOLLOW SHOT SOFT, CENTER.
5.4. FOLLOW SHOT SOFT, RAIL NO. 1 RIGHT SPIN.
5.5. FOLLOW SHOT SOFT, RAIL NO. 2 RIGHT SPIN.
5.6. FOLLOW SHOT SOFT, RAIL NO. 3 RIGHT SPIN.

6.1. FOLLOW SHOT HARD, RAIL NO. 2 LEFT SPIN.
6.2. FOLLOW SHOT HARD, RAIL NO. 1 LEFT SPIN.
6.3. FOLLOW SHOT HARD, CENTER.
6.4. FOLLOW SHOT HARD, RAIL NO. 1 RIGHT SPIN.
6.5. FOLLOW SHOT HARD, RAIL NO. 2 RIGHT SPIN.

MISCUES REFERENCES ON THE CUE BALL

X.1L DRAW SHOT HARD, RAIL NO. 3 LEFT SPIN.
X.1R DRAW SHOT HARD, RAIL NO. 3 RIGHT SPIN.
X.2L DRAW SHOT SOFT, RAIL NO. 3 LEFT SPIN.
X.2R DRAW SHOT SOFT, RAIL NO. 3 RIGHT SPIN.
X.6L FOLLOW SHOT HARD, RAIL NO. 3 LEFT SPIN.
X.6L FOLLOW SHOT HARD, RAIL NO. 3 RIGHT SPIN.

FIG.15

BILLIARD TRAINING DEVICE TO CONTROL THE CUE BALL AFTER IMPACTING A TARGET BALL

CROSS-REFERENCE TO RELATED APPLICATIONS

This application is the National Stage of International Application No. PCT/US2018/060638, filed on 13 Nov. 2018, the contents of each of which are incorporated by reference herein.

FIELD OF THE INVENTION

This invention relates to a device for playing or performing games of sports and, more particularly, to the game of billiards or pool. The device allows having control over the cue ball after striking the target ball. More specifically, this control over the cue ball is called "English". The invention presents different stackable layers that enable the player to perform the following billiard or pool shots: a) Draw Shot (the cue ball comes back after striking the target ball); b) Stop Shot (the cue ball stops after striking the target ball); c) Stun Shot (the cue ball goes forward minimally after striking the target ball); and d) Follow Shot (the cue ball rolls forward after striking the target ball).

BACKGROUND

The game of billiards and pool has been played for many years by a wide variety of people around the world. Pool and billiards are played professionally in many countries. According to the World Confederation of Billiard Sports (hereinafter "WCBS") the popularity of billiards has grown at unprecedented levels in recent times, making pool one of the world's most widely practiced sports. To put billiards in numbers, the WCBS hosts more than 200 competitions around the world, and the participants, just in the United States of America (hereinafter "U.S."), are around 34 million. General revenues from the sale of pool tables and equipment exceeds 2 billion dollars, all while employing more than 32,500 people just in the U.S. Popularity and professionalism of pool and billiards is such that many organizations including the World Professional Billiards and Snooker Association and the WCBS are asking the Olympic Committee to include pool and billiards as a sport for the 2024 Olympic Games.

Despite the sophistication and professionalism reached in pool and billiards, the game is widely played by amateurs and is becoming a fast growing activity among amateurs. The game is played by people who have billiard tables in their homes and at the same time is played in pool halls, taverns and recreational centers. At the same time billiards games can be played by people of all ages.

Although the popularity of the game is improving, learning the game has been a major task, and continues to be a main obstacle to upgrade the performance of amateurs and increase the popularity of the game. Books, videos, tutorials and devices many of them expensive and complex are examples of the different attempts to make the game easier to play and learn.

The present invention, however, will overcome the obstacles mentioned above, being at the same time a device that is affordable, user-friendly and can increase the performance of the players in a very short period of time, while welcoming first and new players of pool who are frequently discouraged from playing a game that seems reserved only for professionals or very experienced players.

DESCRIPTION OF THE RELATED ART

With a few exceptions and variants, pool and billiard games (pool and billiards used interchangeably) are played mostly with a wood or similar material stick called a "cue". The cues have different shapes and are made with a wide range of materials. While more frequent cues are made of wood (eg. Maple, Ash or Oak) other cue materials include aluminum, fiber glass and carbon fiber. It does not matter what materials are used to produce them, the structure or parts of a billiard cue include basically two parts: a) a butt end and b) a shaft. The butt includes different parts: i) a bumper at the end of the butt part; ii) a butt cap continues to the bumper; iii) a wrap or grip; and iv) a forearm. The shaft part includes a i) tapered shaft projecting from the butt end part, ii) a ferrule at the other end of the cue, and finally, iii) a tip that impacts the cue ball. The purpose of the game consist of a billiard player hitting a specific ball (cue ball) making the cue ball roll and hit another ball, inserting the latest mentioned ball into one of the six pockets on a billiard table. In order to hit the cue ball, a billiard player basically grasps the butt end of the cue by the grip with one hand and holds the shaft with the other hand. The right way for a player to hold the cue shaft with his hand is called a bridge. A bridge is formed by placing a hand on the table and spreading the fingers apart such that the cue can smoothly slide between the fingers that hold the cue shaft. Finally, the billiard player executes a shot by moving the cue longitudinally relative to the bridge hand with a stroke.

One of the major problems of pool is to learn how to make the technique called "English". As it is cited in U.S. Pat. No. 5,322,475, the "( . . . ) English is defined as the spin applied to a ball by striking it in a particular location. More specifically, 'Right English' is the spin applied to a ball by striking it to the right of center to create a counter clockwise spin on the ball. 'Left English' is the spin applied to a ball by striking it to the left of center to create a clockwise spin on the ball. 'Draw' is the spin applied to a ball by striking it below center to create a back spin. 'Follow' is the spin applied to a ball by striking it above center to create a forward spin. These and other various types of spin are applied to the ball through use of a stroke, defined as the movement of the hands and arms to strike a ball with a stick, pool cue, billiard stick, or other apparatus. The development and application of the stroke necessary to produce the spin or the ball movement desired is difficult to master. Use of a teaching aid or a training device to enhance the development of the hand-eye coordination and/or muscle memory necessary to repetitively produce such an effect will be beneficial. Heretofore, a training cue ball that assists a user in creating spin on such cue ball has not been developed". In addition, the "Stop Shot" is when the cue ball stops dead after striking the target ball. Generally this effect is produced when the player hits the cue ball below center. Finally, the "Stun Shot" is, when on a straight shot, the cue ball will go forward minimally after striking the target ball.

The prior art does not describe any device that allows the player to perform an English properly. The only methods known to perform English come from books, videos, tutorials and from a wide variety of pool or billiard training balls. On one hand, methods from books, tutorials and videos are difficult to put in practice. On the other hand, training balls do not teach and/or help the player to perform adequately an English. Three reasons why training balls do not serve to practice the English will be mentioned as follows: a) First, the training balls—such as Jim Rempe™ training ball—does not resolve the problem of how to teach the player to hit a sphere object. Basically these training balls have different points labeled on the ball faces that indicate the user where to hit the training ball. However, it is very common to see that many players, especially beginners and amateurs, cannot control the cue stick making it too difficult for them to use the training balls to perform the English. Thus, when these players hit the training ball, especially some points of the training ball, they may miscue and/or apply the wrong English; b) Second, these training balls are not a good practical learning device since they are supposed to work when the training ball is completely horizontal and perpendicular with the table. At the same time it can be said that most players cannot align and/or they waste too much time to align these training balls making them leave the training device and/or the game; and c) Third, these balls are not a great training device because they do not help the player to solve or to correct the different perspectives from where the player is viewing the training ball.

A wide variety of pool or billiard balls or training devices having visible training patterns are known in the prior art, among them: a) U.S. Pat. No. 1,108,441 described a pool ball with zig-zag lines which helps the player visualize more properly the ball; b) U.S. Pat. No. 3,993,305 describes a training object ball for use in teaching billiard players to sight an object ball by a method of "sighting by object ball displacement"; c) U.S. Pat. No. 3,947,026 provides a billiard training device for simultaneously providing a visual indication of a desired point of aim for the cue ball and desired point of contact with an object ball, to propel the latter in a certain desired position; d) U.S. Pat. No. 3,843,120 describes a training device which aids in teaching the true point of aim and/or desired points of contact to be used in a pool or billiards game; and e) U.S. Pat. No. 8,523,693 B2 describes a device and method of aiming pocket billiard balls for training purposes where a ball is used for aiming to impact an object ball for motion of the object ball in a desired direction, having the training ball with a series of lines on the outer surface. While the mentioned group of patents relates to aiming how to pocket a certain target ball, the only prior art found that relates to the English is provided by U.S. Pat. No. 5,322,475. This patent presents a practice cue ball for training with a leveling device inserted in the cue ball. Due to the leveling device inserted in the training ball, however, the density of the cue ball changes and the mass of the ball loses its balance.

Consequently, all these inventions described in the prior art do not provide the player with a useful solution, since most of them consist of a sort of training ball with all the drawbacks already underlined. Further, none of these patents improve performance and/or teach the player how to improve the English.

SUMMARY OF THE INVENTION

It is an objective of the present invention to provide a simple, useful, user-friendly and affordable training device to control the cue ball after striking the target ball in order to improve the efficiency and performance of pool and/or billiard players.

According to the foregoing objective, the present invention provides a set of different stackable layers that will enable the player to practice and perform the following billiard shots as well as to avoid miscue shots: a) Draw Shot (the cue ball comes back after striking the target ball); b) Stop Shot (the cue ball stops after striking the target ball); c) Stun Shot (the cue moves forward minimally after striking the target ball); and d) Follow Shot (the cue ball rolls forward after striking the target ball). Differently to the training and labeled balls or similar devices described in the prior art, in which the player needs to focus the attention in a certain point in a sphere object or imagine a certain point on the table, this invention provides a set of layers easily and securely attachable to one another, depending on the player's shot, that serves as a controlled and reliable guide that dictates to the player the right height over which the player needs to slide the cue shaft before striking the cue ball.

One of the main advantages of this invention is the fact that the different heights of the layers for the corresponding shots (Draw, Stop, Stun and Follow shots and miscue) have been precisely measured so as to provide the player the exact height and point where he/she must hit the cue ball in order to place the cue ball in a determined position after striking the target ball.

Another advantage of the present invention is that the different layers prevent the player from moving the cue tip below the layers making them act as a support guide over which the player should slide the cue shaft to perform the shot. In consequence, once the player has practiced enough with the layers, he/she will have learned the right height for the stroke depending on the required shot. For this reason, the more the player uses the layers, the more the player will learn the right height for his/her strokes, and thus the better the stroke will be.

According to this invention, the player can perform different shots just by staking certain layers over the others and then by placing the device, which has a concave groove on one extreme, before the cue ball in order to guide the stroke. In particular, this invention consists of seven stackable layers and enables the player to perform: 2 Draw shots (Draw Shot Hard and Draw Shot Soft); 1 Stop shot; 1 Stun shot; and 2 Follow shots (Follow Shot Soft and Follow Shot Hard); and to prevent at least 2 miscues. The differences between the shots of the same class (e.g. Draw Hard Shot and Draw Soft Shot) vary in the intensity of the effect that the class relates to. For example, "Follow Hard" will make the cue ball moves further after striking the target ball than "Follow Shot Soft". Respectively, "Draw Shot Soft" will make the cue ball roll back less than the "Draw Shot Hard".

For the purpose of this invention, the player needs to steep the cue stick in the range of 0 to 5 degrees considering a horizontal position in a parallel line to the table to be 0 degree. In addition to perform the above mentioned shots, the player must strike the cue ball at a normal playing speed. "Normal playing speed" is defined herein as the speed in between of a "breaking" or "opening" shot and a "pocket-speed" shot. "Pocket-speed" refers to the velocity at which there is just enough speed for the objet ball to reach the pocket, but ideally not so hard that a miss would cause sufficient rebound to leave the player's opponent a return bank.

The following chart (Table 1) shows the optimal heights at which the player needs to hit the cue ball in order to perform the above mentioned shots.

TABLE 1

| Name of shot | Optimal Height to hit the cue ball | Range of height to hit the cue ball |
|---|---|---|
| Draw Shot Hard | 15 mm | 13.5 mm to 16.5 mm |
| Draw Shot Soft | 19 mm | 17.5 mm to 20.5 mm |

TABLE 1-continued

| Name of shot | Optimal Height to hit the cue ball | Range of height to hit the cue ball |
|---|---|---|
| Stop Shot | 23 mm | 22 mm to 24 mm |
| Stun Shot | 27 mm | 25 mm to 29 mm |
| Follow Shot Soft | 32 mm | 30 mm to 34 mm |
| Follow Shot Hard | 40 mm | 38 mm to 42 mm |

These layers can include of seven stackable layers including: 1) a Bottom layer or "Bottom", 2) five in-between layers and 3) a Top layer or "Top". Bottom and Top are always used when stacking the in-between layers. In this sense, and to perform a shot, the player must stack at least the Top, and/or more in-between layers in addition to the Top layer, over the Bottom. The last layer to place over the Bottom and/or the different layers in-between is the Top. The layers in between are numbered from 1 to 5.

In order to reach the exact height for the different shots described in Table 1, the player must combine certain layers so as to reach the mentioned desirable heights. Each layer has a precise height and this invention provides the right combination of them to reach the heights described in Table 1. In order to reach the height desired, the height of the combination of certain layers must be added to the height of the radio of the cue tip used by the player. For example, if the player wishes to perform a Stop Shot, the player needs to hit the cue ball with the center of his cue tip at a height of 23 mm. To proceed accordingly, the player must add the height of the radio of the cue tip to the height of a combination of layers until he/she reaches the values in Table 1. If the player uses a cue tip of 13 mm, the tip's radio is 6.5 mm, and to equal 23 mm, he/she needs to add a combination of stackable layers of a height of 16.5 mm (Calculation is: 23 mm [Optimal height for the shot]−6.5 [radios of tip]=16.5 mm [Height of combination of layers]).

While the height of each layer does not vary, the height of the cue tip can vary according to the diameter of the cue tip used by the player. Cue sticks come in various lengths, thicknesses and sizes, and therefore have varying tip diameters. Even though the valid range known for cue tips is from 10 mm to 14 mm, it can be concluded that the diameter of the majority of cue tips are between 11.5 mm and 13 mm. Consequently, it can be concluded that the maximum variation of the height due to the cue tip is a radius of 2 mm (14 mm cue tip−10 mm cue tip/2=2 mm). This height of 2 mm, however, does not change the nature of the shot named in Table 1 according to the information and trials conducted for this invention. For the purpose of this invention, many trials have been conducted, and it can be said that the right combination of layers for a certain shot did not change if the player used a cue tip of 13 mm or 10 mm diameter. The angle of the cue stick was in the range of 0 to 5 degrees considering 0 degrees is the horizontal position in a parallel line to the table. Finally, the shapes of the cue tips tested belong to two groups: "dime" and "nickel" shape. Dime (10 cents) is smaller in size than nickel (5 cents). Thus, "dime-shaped" cue tips are rounder than "nickel-shaped" tips.

The heights of the stackable layers are provided in Table 2. Although the length and width of the layers can vary, in a preferred embodiment, the length is 120 mm and width is 120 mm, and the length from the deepest side of the concave groove to the opposite side of the layer is 90 mm.

TABLE 2

| Name of Layer | Height of Layer |
|---|---|
| Bottom Layer | 5 mm |
| Top Layer | 4 mm |
| Layer in-between No. 1 | 4 mm |
| Layer in-between No. 2 | 4 mm |
| Layer in-between No. 3 | 4 mm |
| Layer in-between No. 4 | 5 mm |
| Layer in-between No. 5 | 8 mm |

Table 3(a) shows three major columns as follow: (i) the Name of the Shots according to Table 1, (ii) Layer Count and (iii) the combinations of layers in order to perform the six shots described in Table 1.

TABLE 3(a)

| Name of Shot | Layer Count | Layer involved in the shot |
|---|---|---|
| Draw Shot Hard | 2 | Bottom + Top |
| Draw Shot Soft | 3 | Bottom + Layer 1 + Top |
| Stop Shot | 4 | Bottom + Layers 1-2 + Top |
| Stun Shot | 5 | Bottom + Layers 1-2-3 + Top |
| Follow Shot Soft | 6 | Bottom + Layers 1-2-3-4 + Top |
| Follow Shot Hard | 7 | Bottom + Layers 1-2-3-4-5 + Top |

Table 3(b) shows four columns: (i) Name of the Shots; (ii) Optimal height to hit the cue ball, also shown in Table 1; and (iii) the heights of the combination of layers involved as it is shown in Table 3(a) for the different shots mentioned in Table 1, and (iv) Height range of combination of layers per shot.

TABLE 3(b)

| Name of Shot | Optimal Height to hit the cue ball | Height of combination of layers | Height range of combination of layers per shot |
|---|---|---|---|
| Draw Shot Hard | 15 mm | 9 mm | 7.5 mm to 11 mm |
| Draw Shot Soft | 19 mm | 13 mm | 12 mm to 15 mm |
| Stop Shot | 23 mm | 17 mm | 16 mm to 18 mm |
| Stun Shot | 27 mm | 21 mm | 19 mm to 23 mm |
| Follow Shot Soft | 32 mm | 26 mm | 24 mm to 28 mm |
| Follow Shot Hard | 40 mm | 34 mm | 32 mm to 36 mm |

For the purpose of this invention, it must be said that the training device presented herein works as long as the player uses the right combination of layers in between the Bottom and Top no matters the order of layers in between. However, and for teaching purposes the order of layers is established in an increasing manner. In addition, there is a range (Table 3(b), Column 4) of possible heights of the stackable layers in which the different shots described in column 1 of Table 3(b) work properly varying slightly but not affecting the effect of the cue ball after striking the target ball. In calculating the heights described in columns 3 and 4 of Table 3(b), the calculations were made considering that the cue ball is placed over the Slider. On the other hand, the optimal height to hit the cue ball (Column 1, of Table 3(b) was calculated placing the cue ball on the table and not on the Slider.

In addition to the six different shots mentioned before, in a preferred embodiment, the invention provides the player the capacity to direct the desired shot (Draw, Stop, Stun and Follow) whether left, center or right. This feature is provided due to the fact that the Top layer has in its upper surface multiple labeled rails or lines that dictates the player's three possible left and three possible right directions. The three possible left and right directions vary in the intensity of the direction. In these terms, Left Rail No. 3 will make the cue ball move more left than Left Rail No. 2. Left Rail No. 2 will make the cue ball move more left than Left Rail No. 1. Finally, Left Rail No. 3 will make the cue ball move more left than Left Rail No. 1. The same applies when the player shoots the cue ball right. Right Rail No. 3 will make the cue ball move more right than Right Rail No. 2. Right Rail No. 2 will make the cue ball move more right than Right Rail No. 1. Finally, Right Rail No. 3 will make the cue ball move more right than Right Rail No. 1. In addition, the Top has a center sole direction. In a preferred embodiment, the different rails or lines are separated between each other by 3 mm or multiple of 3 millimeters (3 mm; 6 mm; 9 mm; 12 mm, 15 mm; 18 mm; 21 mm; 24 mm; 27 mm or 30 mm). In a more preferred embodiment the separation between the lines is 6 mm-6.5 mm that is the equivalent of half a tip. In an alternative embodiment, the spacing distance among the lines can combine different multiple of 3 mm spacing distance, having for example both rails separated by 6 mm and 12 mm respectively.

Each of the seven different layers comprises at least two magnets and at least two securing knobs male and female respectively. The combination of securing knobs and magnets produces a dual effect on the stackable layers. On one hand, the securing knobs serves to place and keep the different stackable layers aligned in their proper position. On the other hand, the magnets make the different layers attach powerfully to one to another.

Finally, the invention contains a slider (hereinafter defined as "Slider") that is mounted on the floor of the Bottom, and allows the player to always set the cue ball in the center of the concave groove of the device in order use the device accurately. The Slider consists of a thin and rectangle panel made of a flexible material, preferably a transparent material with a width range from 0.5 to 1.2 mm. In a preferred embodiment the width of the Slider is 0.85 mm. The capacity of the Slider to secure the cue ball in the center of the concave groove of the device is provided by a cue ball hole located on one end of the Slider. The cue ball hole serves to always place the cue ball in the center of the concave groove of the device. The Slider is mounted on the Bottom layer in a dovetailed or half dovetailed sliding joint. This kind of joint allows the Slider to glide back and forth through the Bottom layer while the Slider is secured on the Bottom. The slide has no stop part allowing the player to pull over the slider until it is away from the Bottom layer.

The Slider helps the stackable layers being allocated one over the other in such a position that permits the combination of stackable layers to adapt to the sphere shape of the cue ball according to the layers required for the different shots. In addition, the Slider serves the player as a step-by-step learning device, since it allows the player to separate the cue ball from the device while at the same time preserves the desirable height for the shot, making the player gain confidence when they realize they are not gliding the cue shaft over the device but over an imaginary space created by displacement of device.

In an alternative embodiment, the invention comprises a unique piece for each of the six combinations of height mentioned in Table 3(b), said sole piece including: i) at its upper surface a multiple labeled rails that dictates to the player at least one left, one center and one right direction; and ii) a sliding panel mounted on the floor of the sole piece allowing the player to always set the cue in the center of the concave groove of the device in order to use the device accurately depending of the required shot. The Slider consists of a thin rectangle made of a flexible material, preferably a transparent material and width range from 0.5 to 1.2 mm. In a preferred embodiment the width of the Slider is 0.85 mm. The capacity of the Slider to secure the cue ball in the center of the concave groove of the device is provided by a cue ball hole that is located on one end of the Slider. The Slider is mounted at the bottom of the sole piece in a dovetailed or half dovetailed sliding joint. This kind of joint allows the Slider to glide back and forth through the Bottom while the Slider is secured on the device. The Slider has no stop part allowing the player to pull over the slide until it is away from the device.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 15 shows a cue ball displaying all points of contact in the cue ball when using the device including the six different shots of Table 1, and the three different left and right spins and the center sole direction. The bottom of FIG. 15 is a list of all shots and miscues referenced on the cue ball.

DETAILED DESCRIPTION

Figure 1:
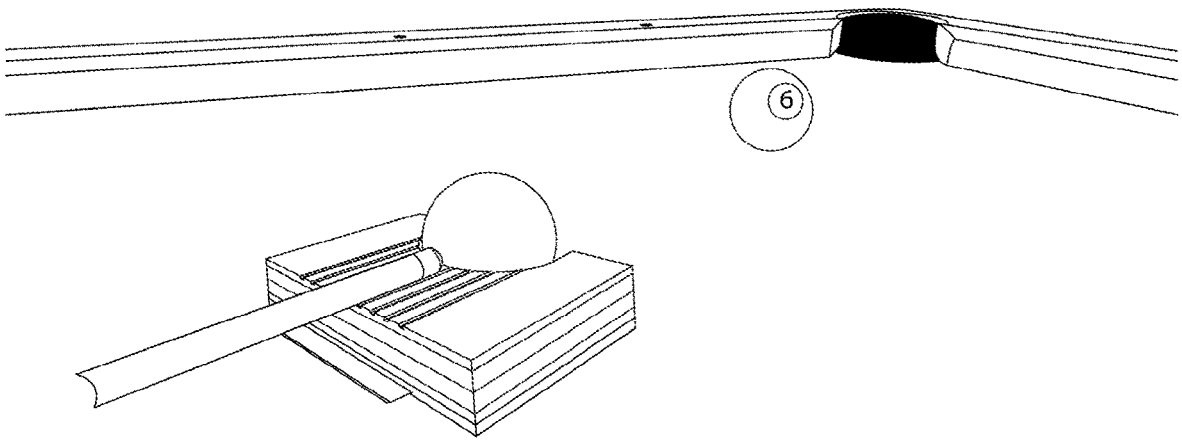
FIG. 1 is an exploded view of a embodiment of the training device according to the present invention.

Referring now to the drawings, FIG. 1 shows the cue shaft over the device and the cue ball placed in the center of the concave groove of the device. The cue shaft is ready to perform a shot to place ball No. 6 into the pocket.

Figure 2:
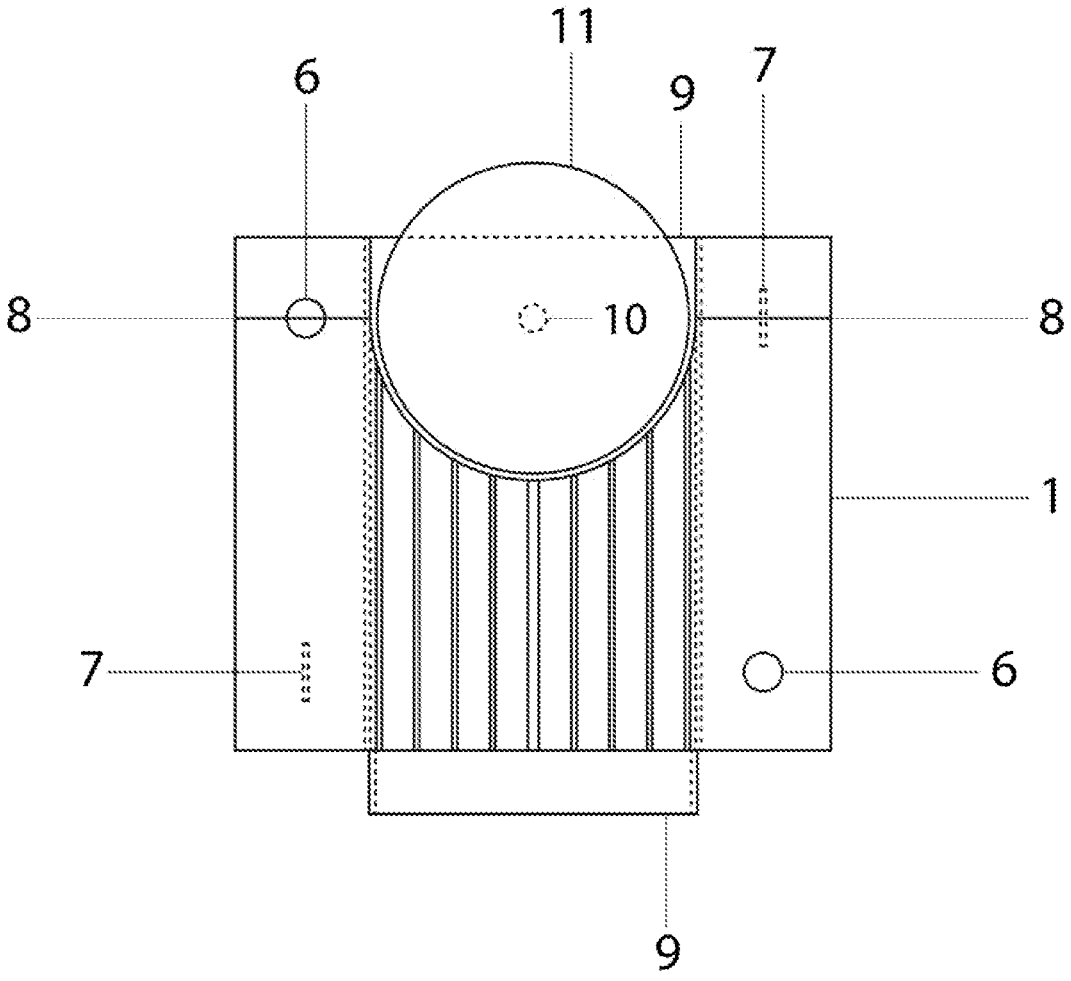
FIG. 2 is an upper view of the device showing the invention placed next to the cue ball.

FIG. 2 shows an upper view of the Top layer displaying the different features of the Top. FIG. 2 depicts the device body 1 having at least two magnets 6 and at least two securing knobs 7 that permit the different layers to attach one to another. In addition, FIG. 2 shows the Slider 9 containing a cue ball hole 10 to always have the cue ball 11 in the center of the concave groove 13 shown in FIG. 5. The FIG. 2 shows a pair of horizontal lines 8 that help the player to visualize the center of the cue ball 11 when it is placed on the concave groove 13 of the device.

Figure 3:
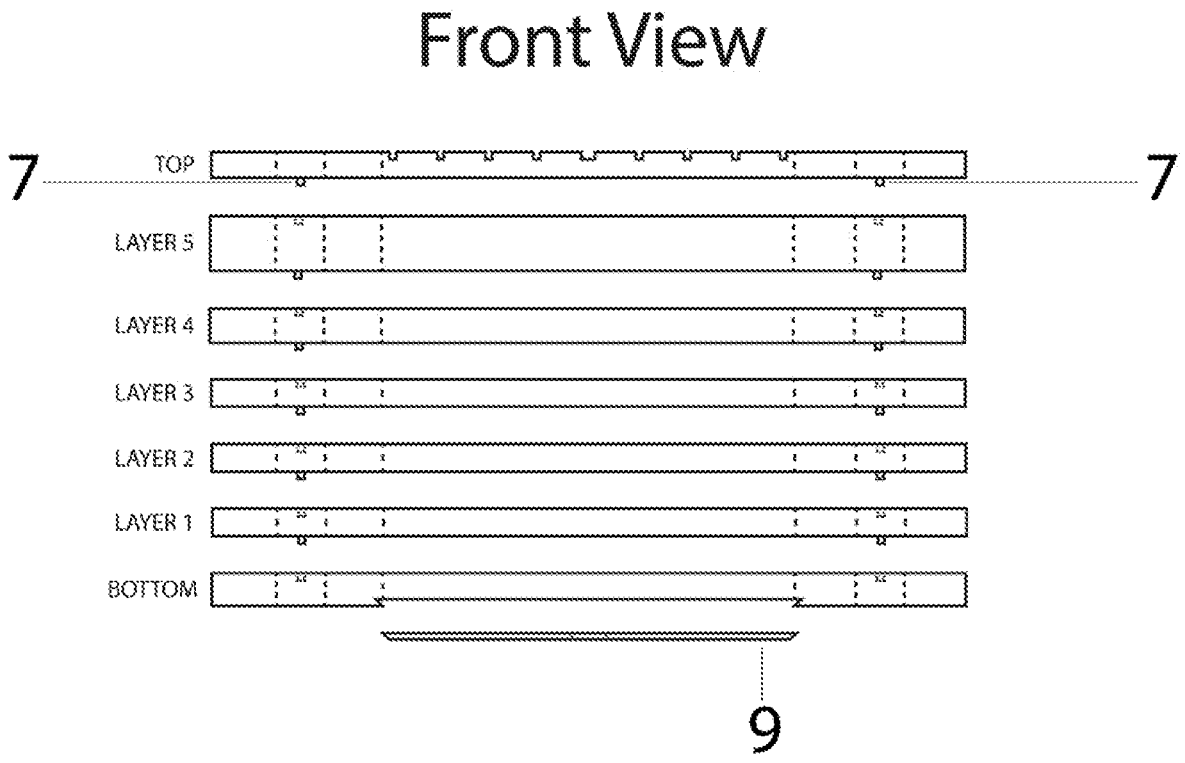
FIG. 3 is a front view of the device showing how the different layers stack one over the other.

FIG. 3 shows a front view of the device containing the seven different stackable layers. The number of each stackable layer is shown on the left side of the device. FIG. 3 shows how the two securing knobs 7 of each layer connect to the other securing knobs of the following stackable layer. At the bottom of the device is the Slider 9 in a half dovetail joint.

Figure 4:
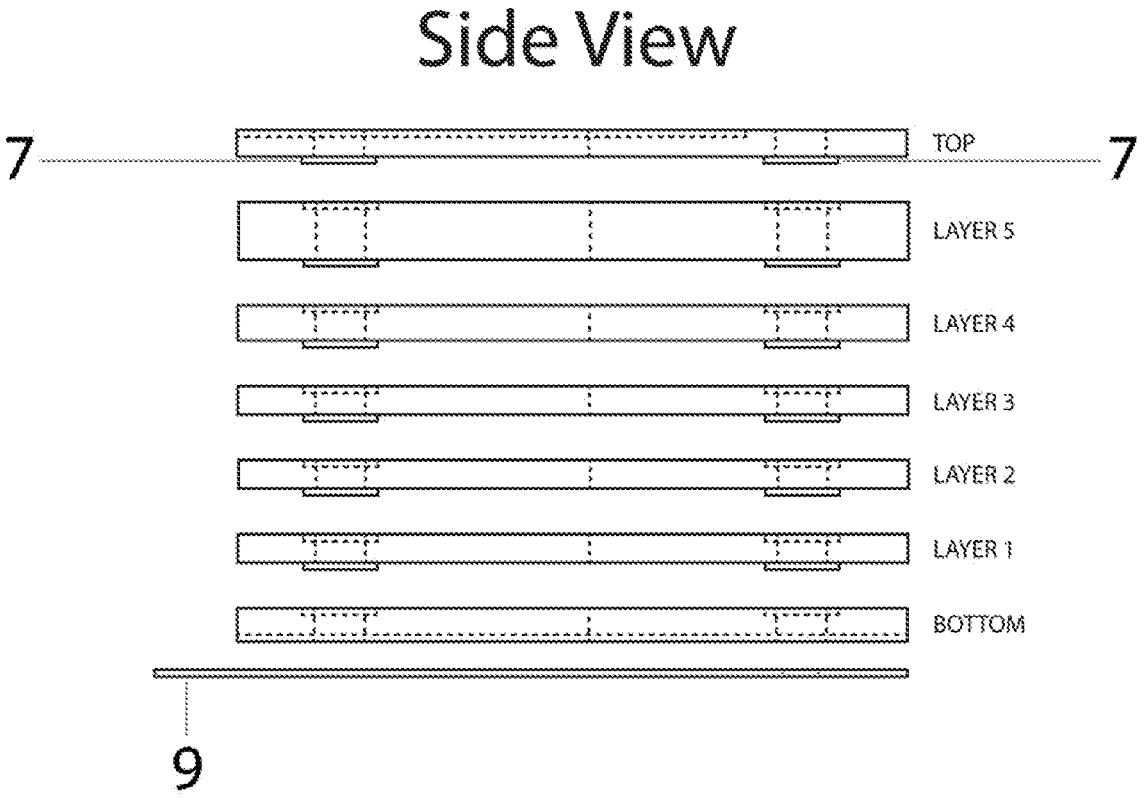
FIG. 4 is a side view of the device showing how the different layers stack one over the other.

FIG. 4 shows a side view of the device containing the seven different stackable layers. FIG. 4 shows how the two securing knobs 7 of each layer connect to the other securing knobs of the following stackable layer. At the floor of the device is the Slider 9.

Figure 5:
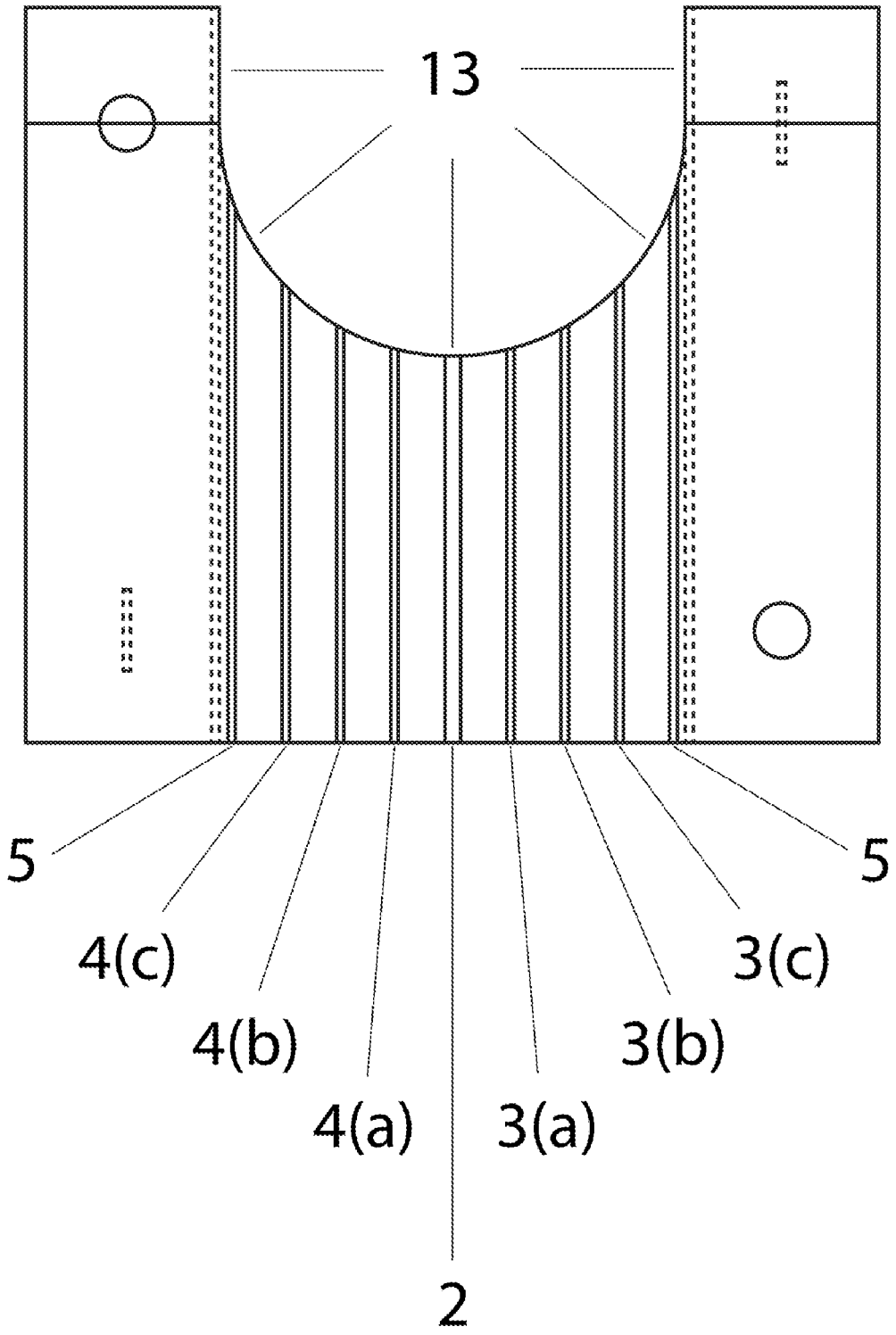
FIG. 5 is an upper view of the Top layer showing the Top's multiple labeled rails that dictates the shot as three different left, three different right, a center sole direction and two miscues.

FIG. 5 shows an upper view of the Top containing the different labeled rails on its surface. In the Top, the center rail 2 and the two miscue rails 5 can be seen. In addition, FIG. 5 shows three rails that direct the cue ball in left direction 4(*a*), 4(*b*) and 4(*c*) in incremental order and intensity, and three right rails that direct the cue ball in right direction 3(*a*), 3(*b*) and 3(*c*) in incremental and intensity order. The concave groove shape 13 of each layer can be seen in the FIG. 5. The concave groove of each layer 13 allows the player to always place the cue ball in the center of the concave groove of the device 1.

Figure 6:
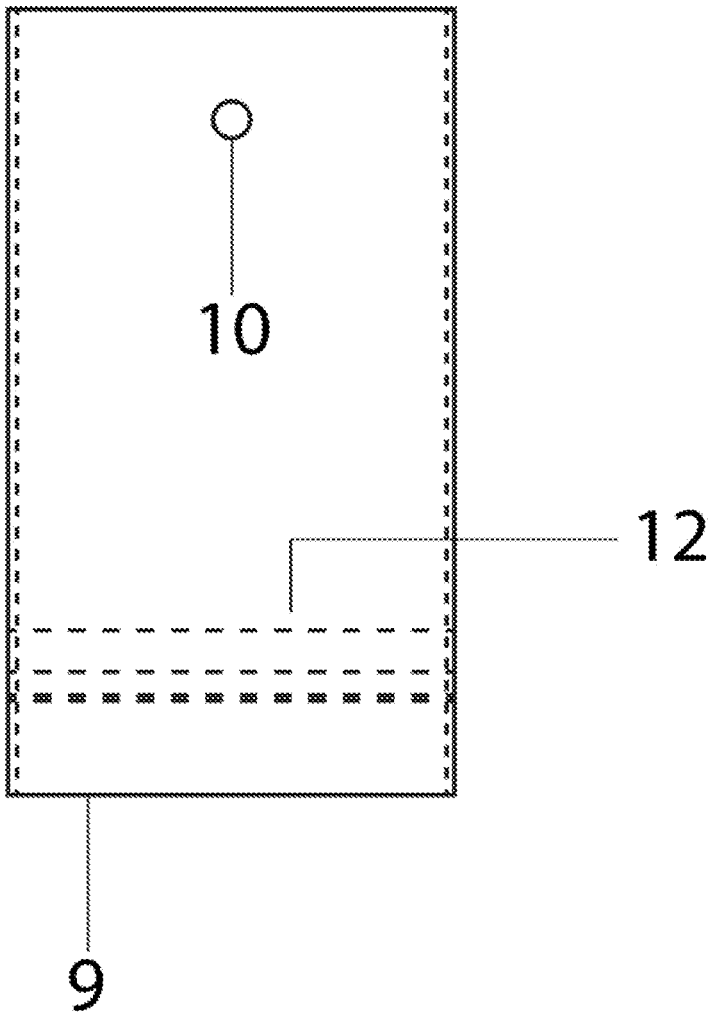
FIG. 6 is a top view of the embodiment of the Slider showing the different marks in one extreme of the Slider indicating the different positions to glide the Slider along the Bottom layer according to the different shots required.

FIG. 6 shows the Slider 9 having a cue ball hole in an end 10 to place the cue ball and different marks 12 to help the player to pull over the Slider to accommodate the cue ball in the correct position in the concave groove of the device. The cue ball hole 10 matches the center of the Top. By grabbing the Slider from the extreme opposite to the cue ball hole 10 the player can redirect up to 360 degrees his/her shot without moving the cue ball from the device. This helps the player since he/she does not need to replace the cue ball for every direction in which the player will strike the cue ball.

Figure 7:
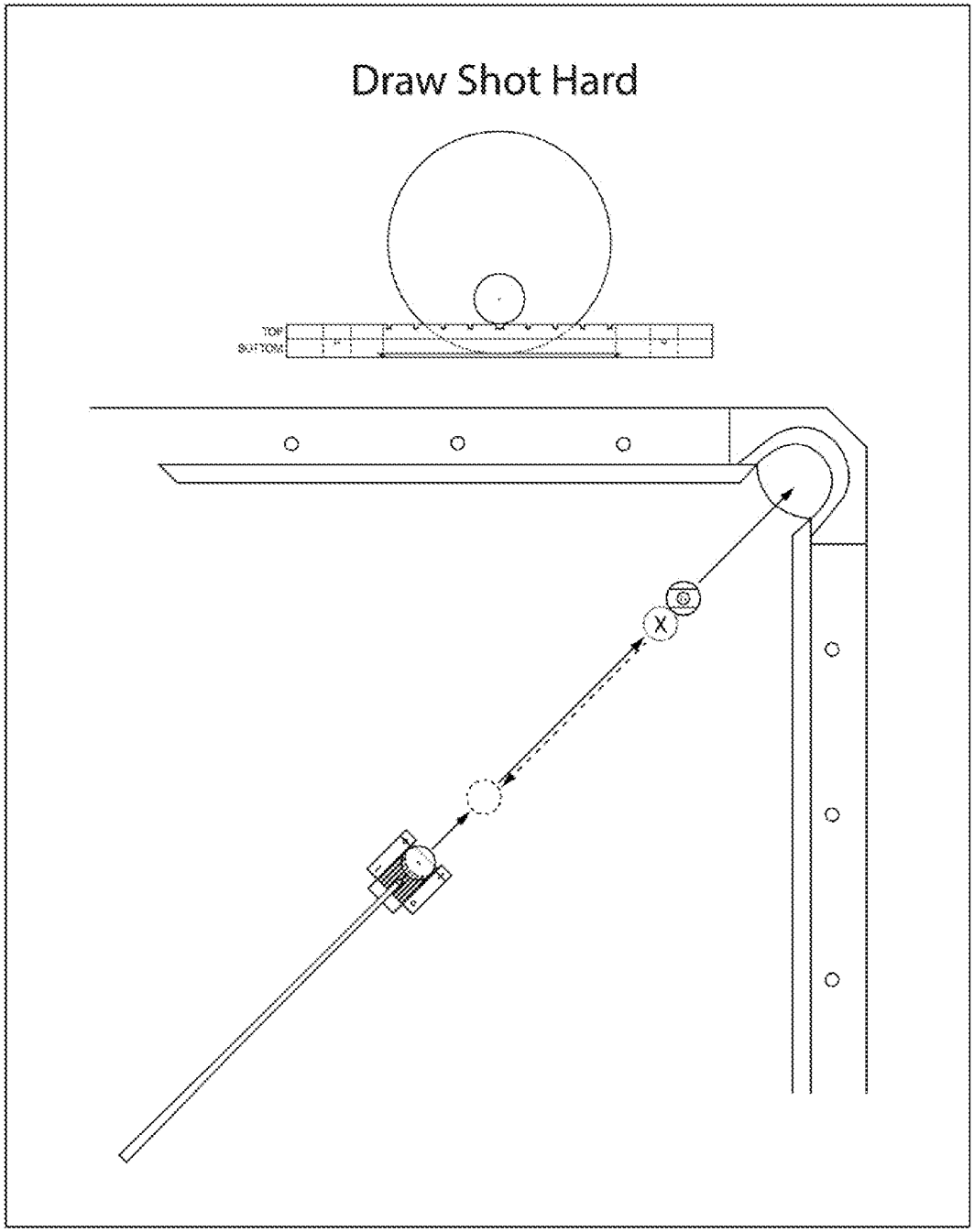
FIG. 7 shows the Bottom and the Top layers for performing the Draw Shot Hard. The bottom figure in FIG. 7 shows the position of the cue ball at the moment of impact on the target ball is represented by a dashed ball figure with a cross inserted. The trajectory and the final position of the cue ball after striking the target ball is represented by a dashed line and dashed cue ball figure respectively.

FIG. 7 shows the device prepared for a Draw Shot Hard. Only the first two layers, Bottom and Top, are involved. The position of the cue ball at the moment of impact on the target ball is represented by a dashed ball figure with a cross inserted. The trajectory and the final position of the cue ball after striking the target ball is represented by a dashed line and dashed cue ball figure respectively. The upper part of FIG. 7 represents the combination of stackable layers for the Draw Shot Hard. The names of the layers involved in the shot are on the left side of each layer.

Figure 8:
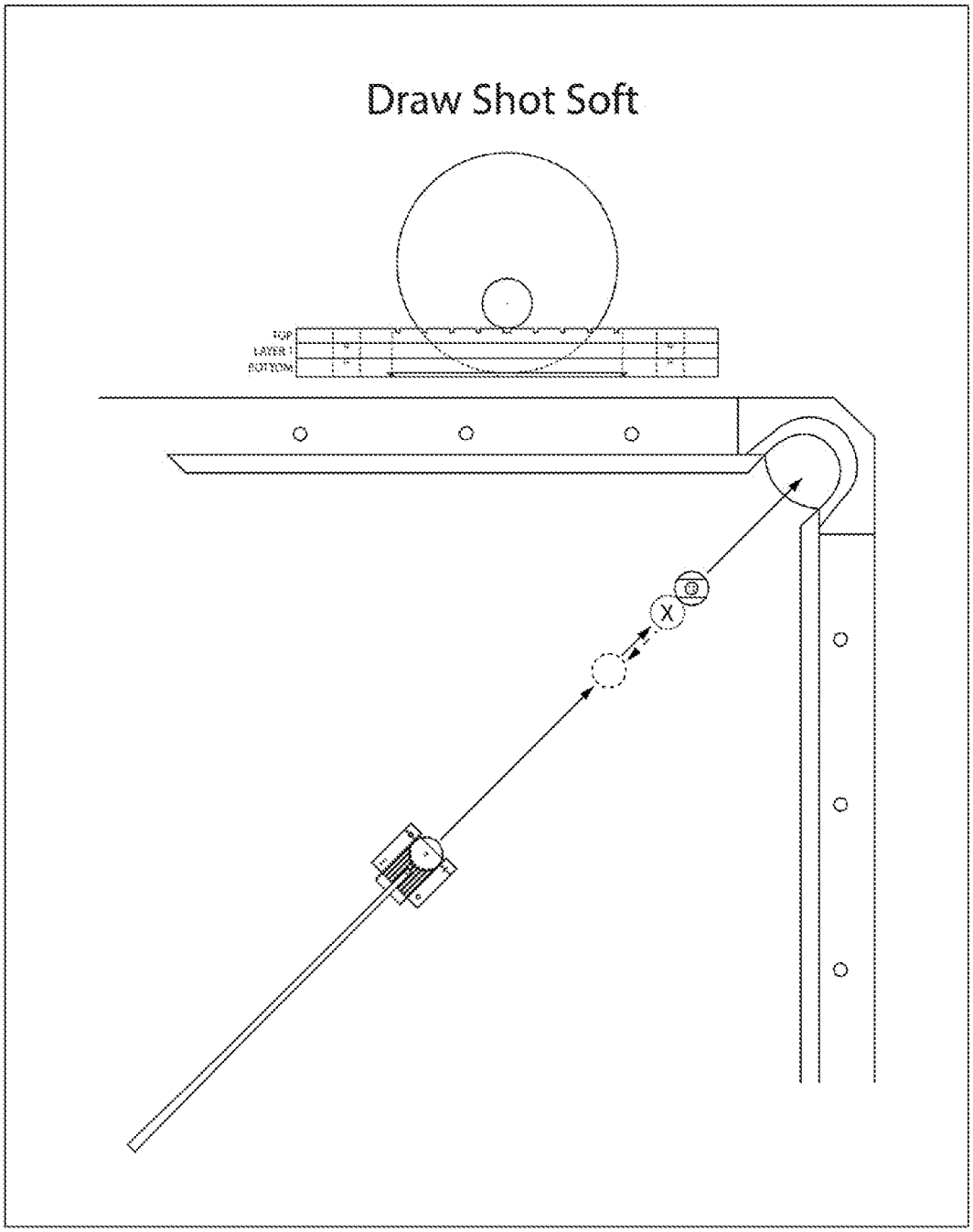
FIG. 8 shows the Bottom, Layer 1 and the Top for performing the Draw Shot Soft. The bottom figure in FIG. 8 shows the position of the cue ball at the moment of impact on the target ball is represented by a dashed ball figure with a cross inserted. The trajectory and the final position of the cue ball after striking the target ball is represented by a dashed line and dashed cue ball figure respectively.

FIG. 8 shows the device prepared for a Draw Shot Soft. The Layers involved are Bottom, Layer 1 and Top. The position of the cue ball at the moment of impact on the target ball is represented by a dashed ball figure with a cross inserted. The trajectory and the final position of the cue ball after striking the target ball is represented by a dashed line and dashed cue ball figure respectively. The top figure in FIG. 8 shows the combination of stackable layers for the Draw Shot Soft. The names of the layers involved in the shot are on the left side of each layer.

Figure 9:
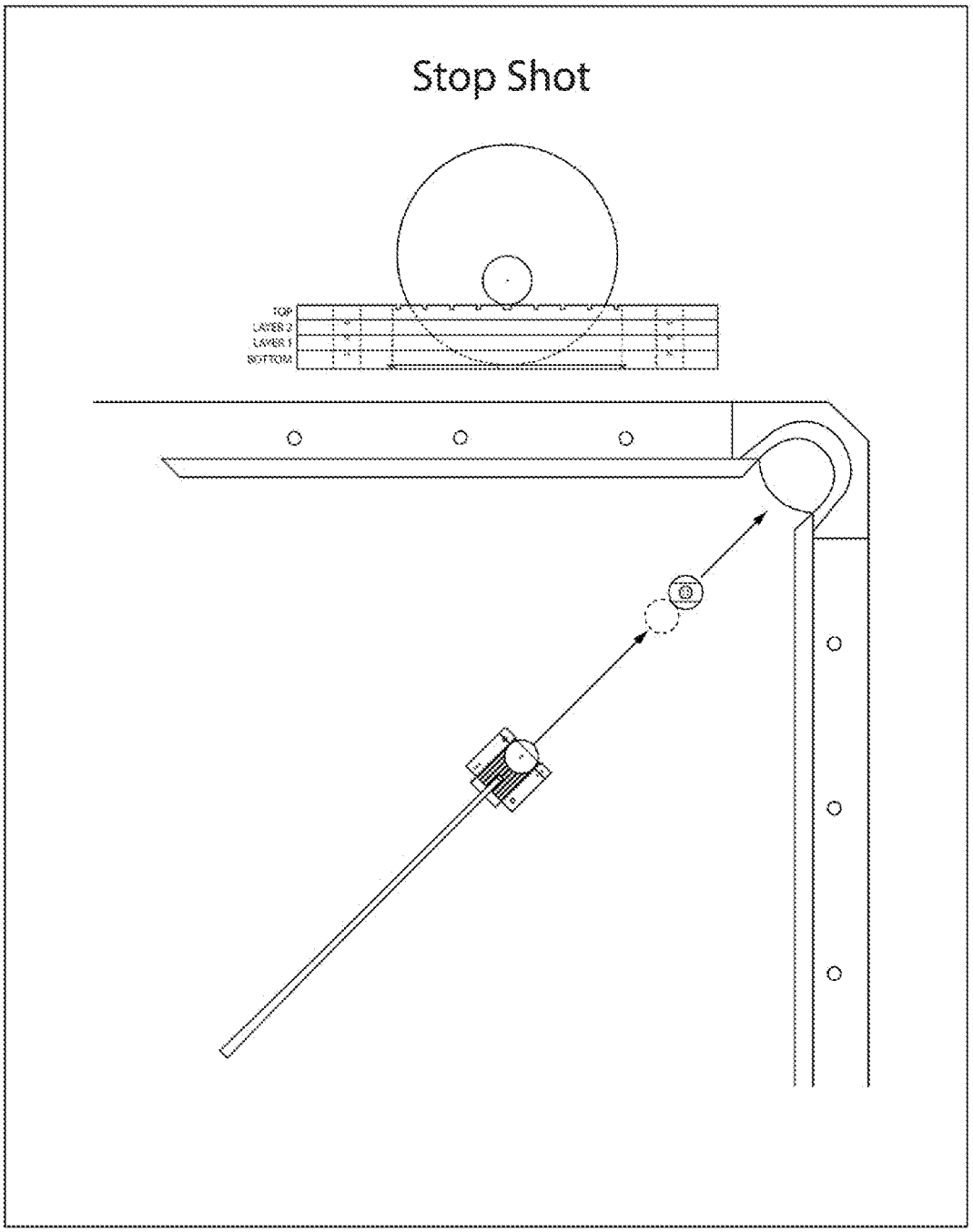
FIG. 9 shows the Bottom, Layers 1 and 2, and Top for performing the Stop Shot. The bottom figure in FIG. 9 shows the final position of the cue ball after striking the target ball is represented by a dashed cue ball figure.

FIG. 9 shows the device prepared for a Stop Shot. The Layers involved are Bottom, Layers 1 and 2, and Top. The position of the cue ball at the moment of impact and final position is represented by a dashed cue ball figure. The top figure in FIG. 9 shows the combination of stackable layers for the Stop Shot. The names of the layers involved in the shot are on the left side of each layer.

Figure 10:
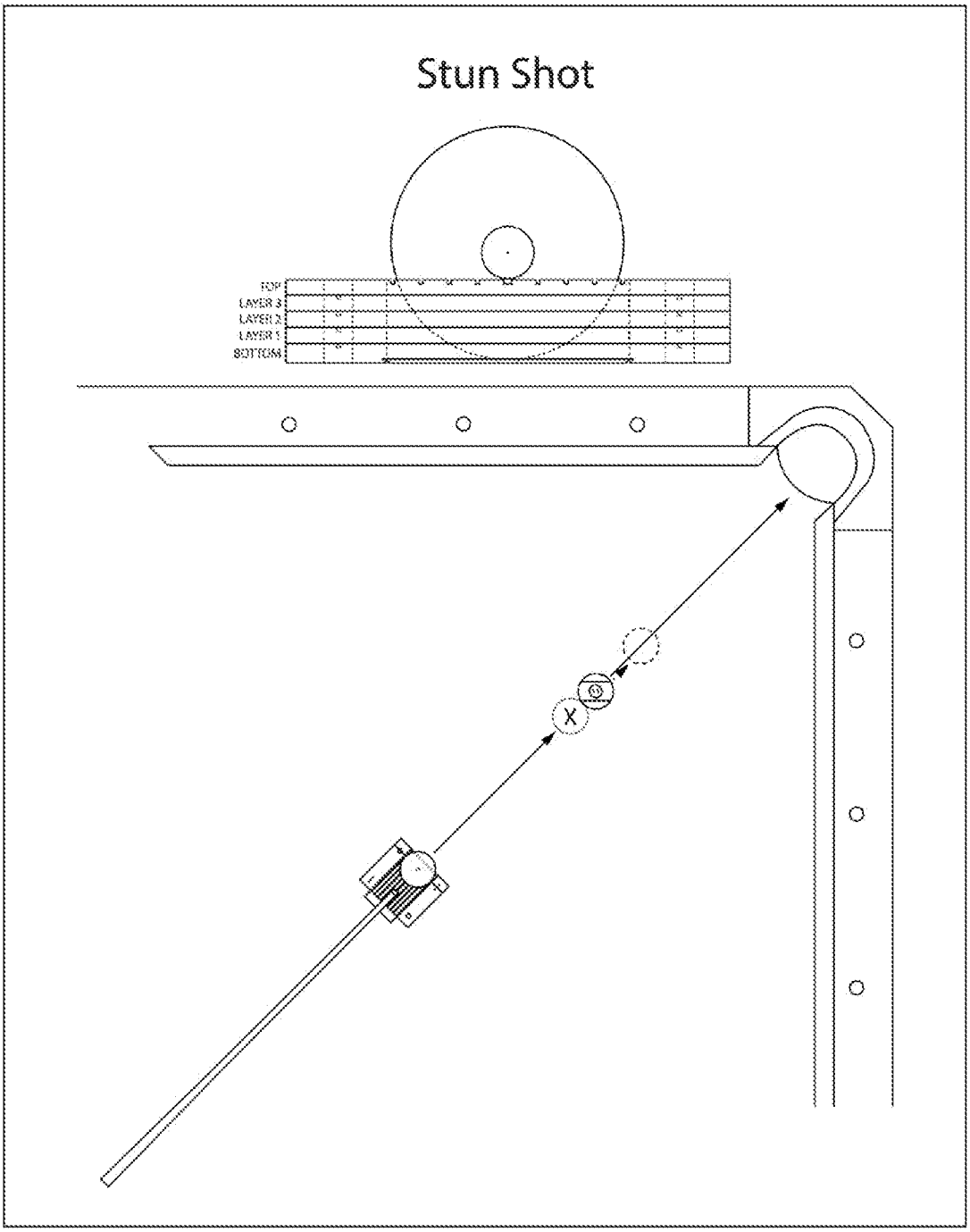
FIG. 10 shows the Bottom, Layers 1, 2, 3, and Top for performing the Stun Shot. The bottom figure in FIG. 10 shows the position of the cue ball at the moment of impact on the target ball is represented by a dashed ball figure with a cross inserted. The trajectory and the final position of the cue ball after striking the target ball is represented by a dashed line and dashed cue ball figure respectively.

FIG. 10 shows the device prepared for a Stun Shot. The Layers involved are Bottom, Layers 1, 2, 3, and Top. The position of the cue ball at the moment of impact on the target ball is represented by a dashed ball figure with a cross inserted. The trajectory and the final position of the cue ball after striking the target ball is represented by a dashed line and dashed cue ball figure respectively. The top figure in FIG. 10 shows the combination of stackable layers for the Stun Shot. The names of the layers involved in the shot are on the left side of each layer.

Figure 11:
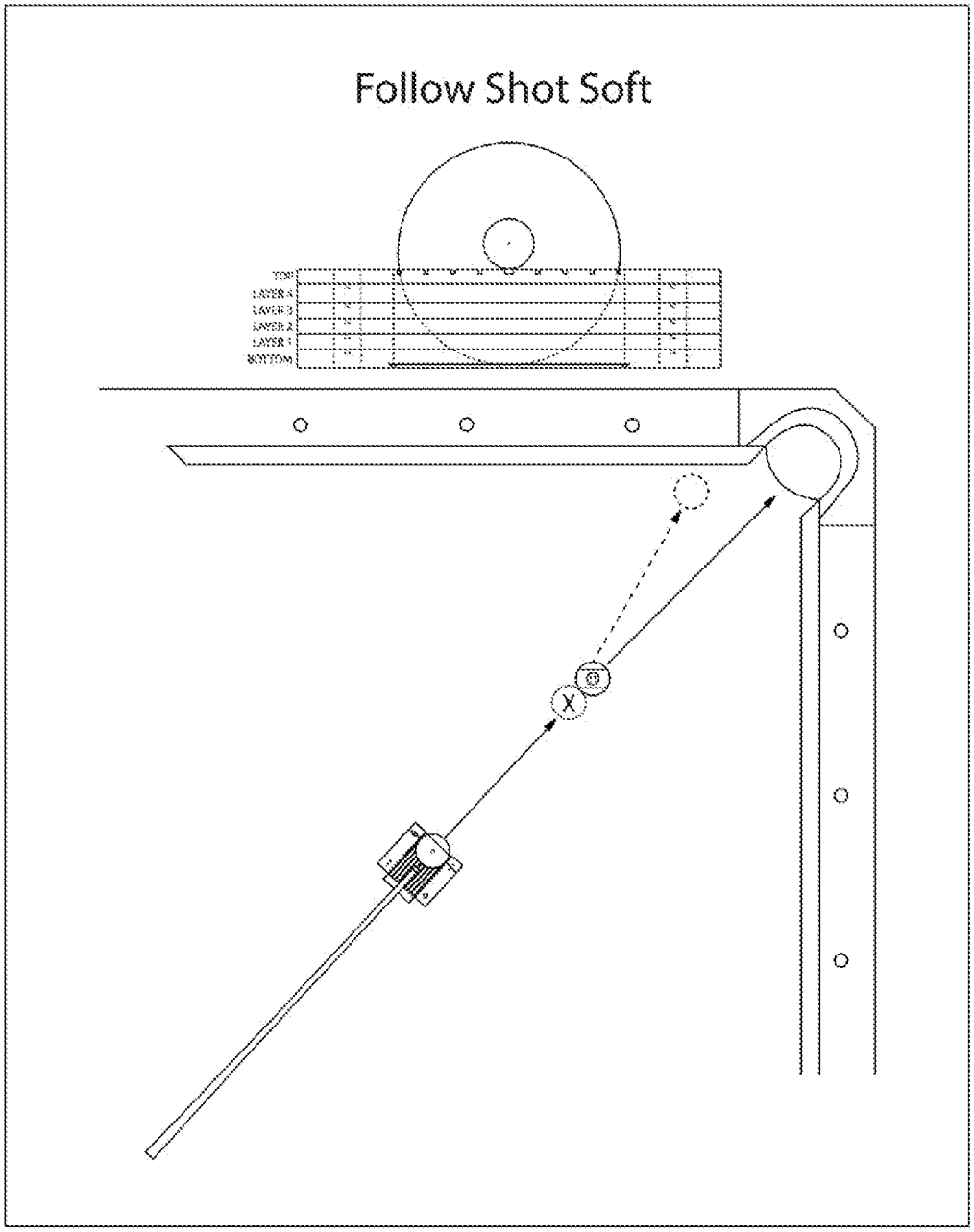
FIG. 11 shows the Bottom, Layers 1, 2, 3, 4, and Top for performing the Follow Shot Soft. The bottom figure in FIG. 11 shows the position of the cue ball at the moment of impact on the target ball is represented by a dashed ball figure with a cross inserted. The trajectory and the final position of the cue ball after striking the target ball is represented by a dashed line and dashed cue ball figure respectively.

FIG. 11 shows the device prepared for a Follow Shot Soft. The Layers involved are Bottom, Layers 1, 2, 3 and 4, and Top. The position of the cue ball at the moment of impact on the target ball is represented by a dashed ball figure with a cross inserted. The trajectory and the final position of the cue ball after striking the target ball is represented by a dashed line and dashed cue ball figure respectively. The top figure in FIG. 11 shows the combination of stackable layers for the Follow Shot Soft. The names of the layers involved in the shot are on the left side of each layer.

Figure 12:
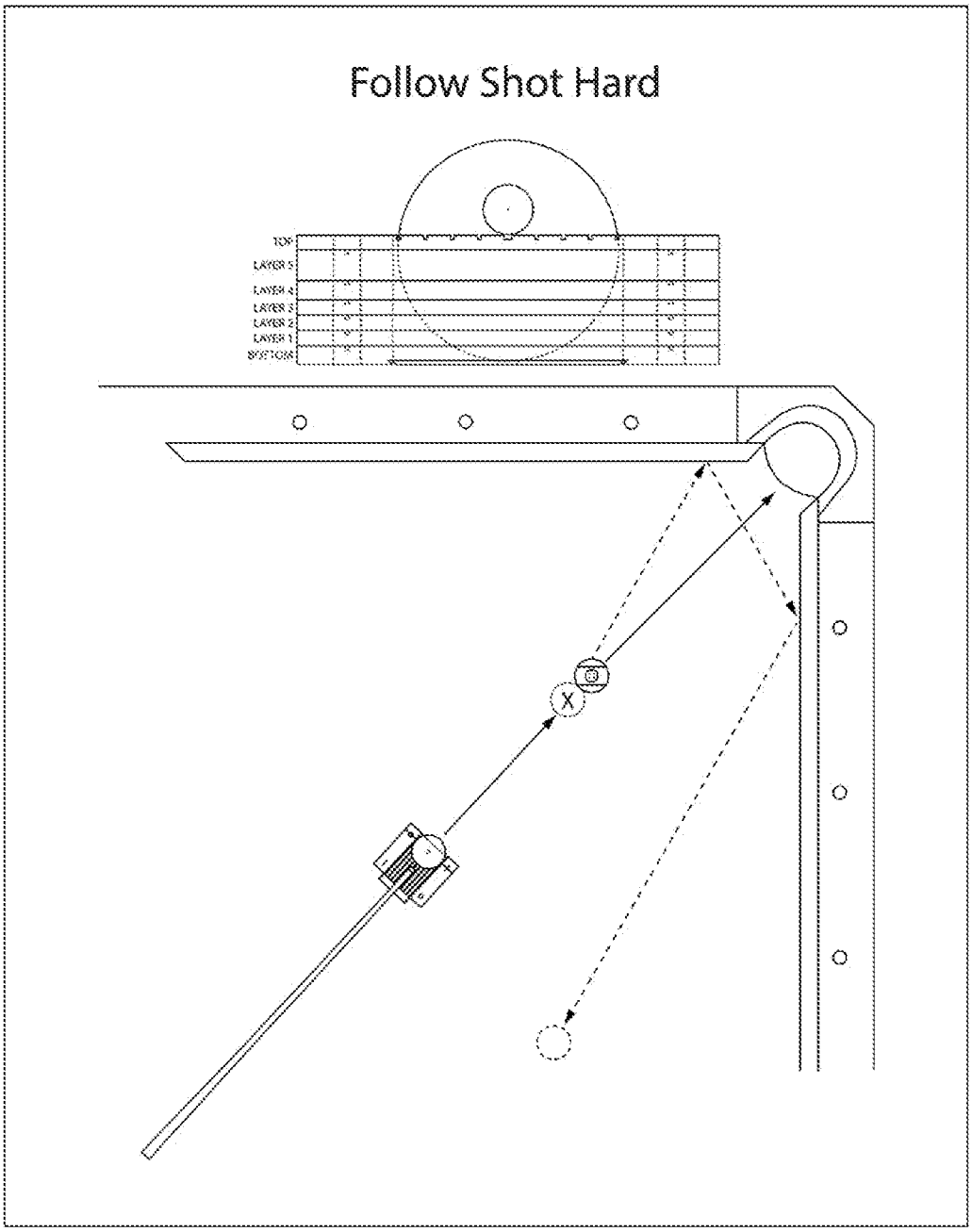
FIG. 12 shows the Bottom, Layers 1, 2, 3, 4, 5 and Top piece for performing the Follow Shot Hard. The bottom figure in FIG. 12 shows the position of the cue ball at the moment of impact on the target ball is represented by a dashed ball figure with a cross inserted. The trajectory and the final position of the cue ball after striking the target ball is represented by a dashed line and dashed cue ball figure respectively.

FIG. 12 shows the device prepared for a Follow Shot Hard. The Layers involved are Bottom, Layers 1, 2, 3, 4 and 5, and Top. The position of the cue ball at the moment of impact on the target ball is represented by a dashed ball figure with a cross inserted. The trajectory and the final position of the cue ball after striking the target ball is represented by a dashed line and dashed cue ball figure respectively. The top figure in FIG. 12 shows the combination of stackable layers for the Follow Shot Hard. The names of the layers involved in the shot are on the left side of each layer.

Figure 13:
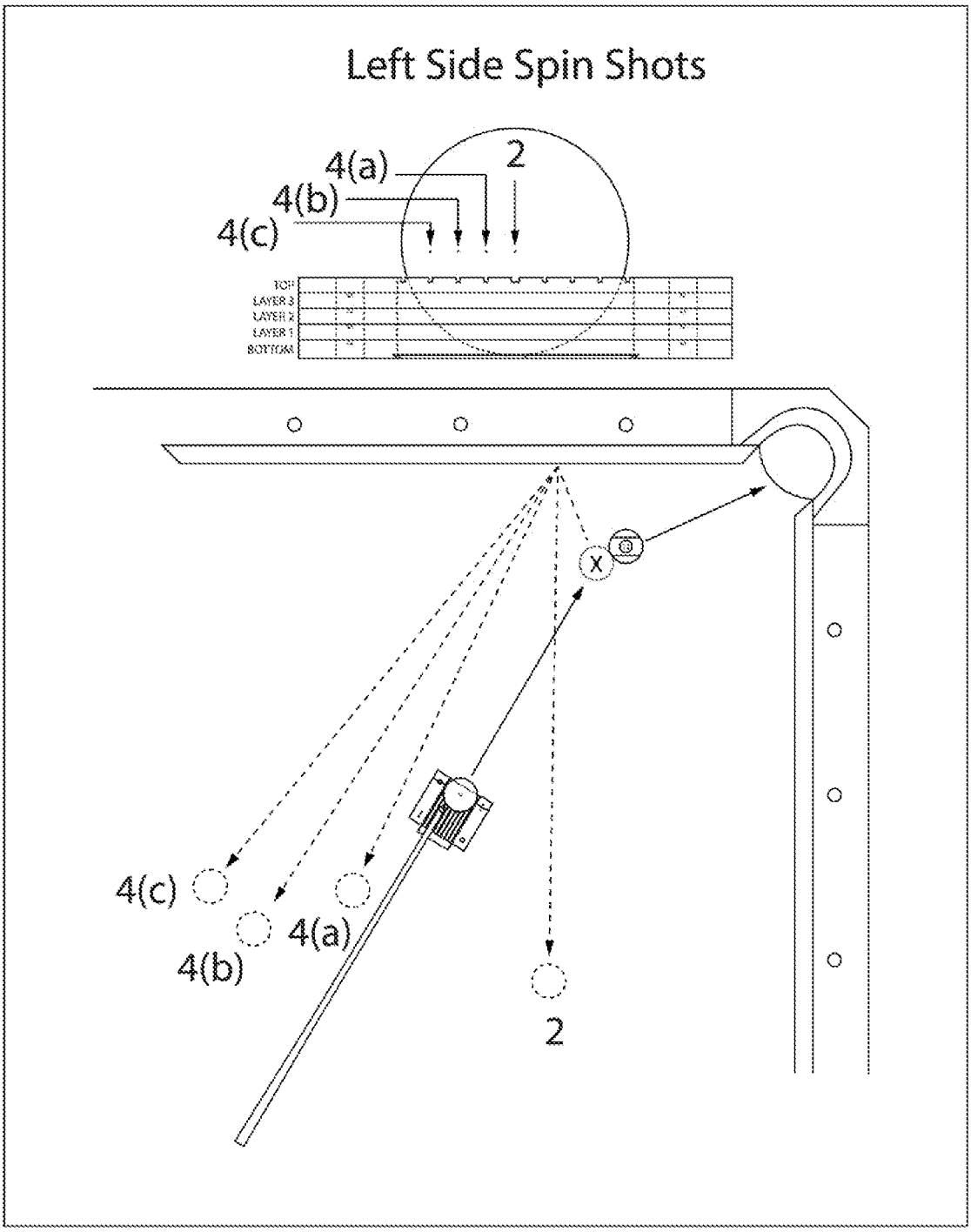
FIG. 13 shows a front view of the device when performing a Center Shot and Left Spin Shots and displaying the three left spin directions and the center sole direction. The bottom figure in FIG. 13 shows the position of the cue ball at the moment of impact on the target ball is represented by a dashed ball figure with a cross inserted. The trajectories and the three final left positions of the cue ball after striking the target ball are represented by three dashed lines and by three dashed cue ball figures respectively.

FIG. 13 shows the device prepared and displaying the different positions of the cue ball after impacting the target ball depending on the intensity of the left spins used. Rail represented in 4(*c*) makes the cue ball veer more left after impacting the cue ball then rail 4(*b*) and 4(*a*), and rail 4(*b*) makes the cue ball veer more left after impacting the target ball then rail 4(*a*). Accordingly, three left trajectories and three left final positions of the cue ball after striking the target ball are represented by three dashed lines and three dashed cue ball FIGS. 4(*a*), 4(*b*) and 4(*c*). When the player uses the center line 2 of the device, the trajectory and the final position of the cue ball after impacting the target ball are represented by a dashed line and dashed cue ball FIG. 2.

Figure 14:
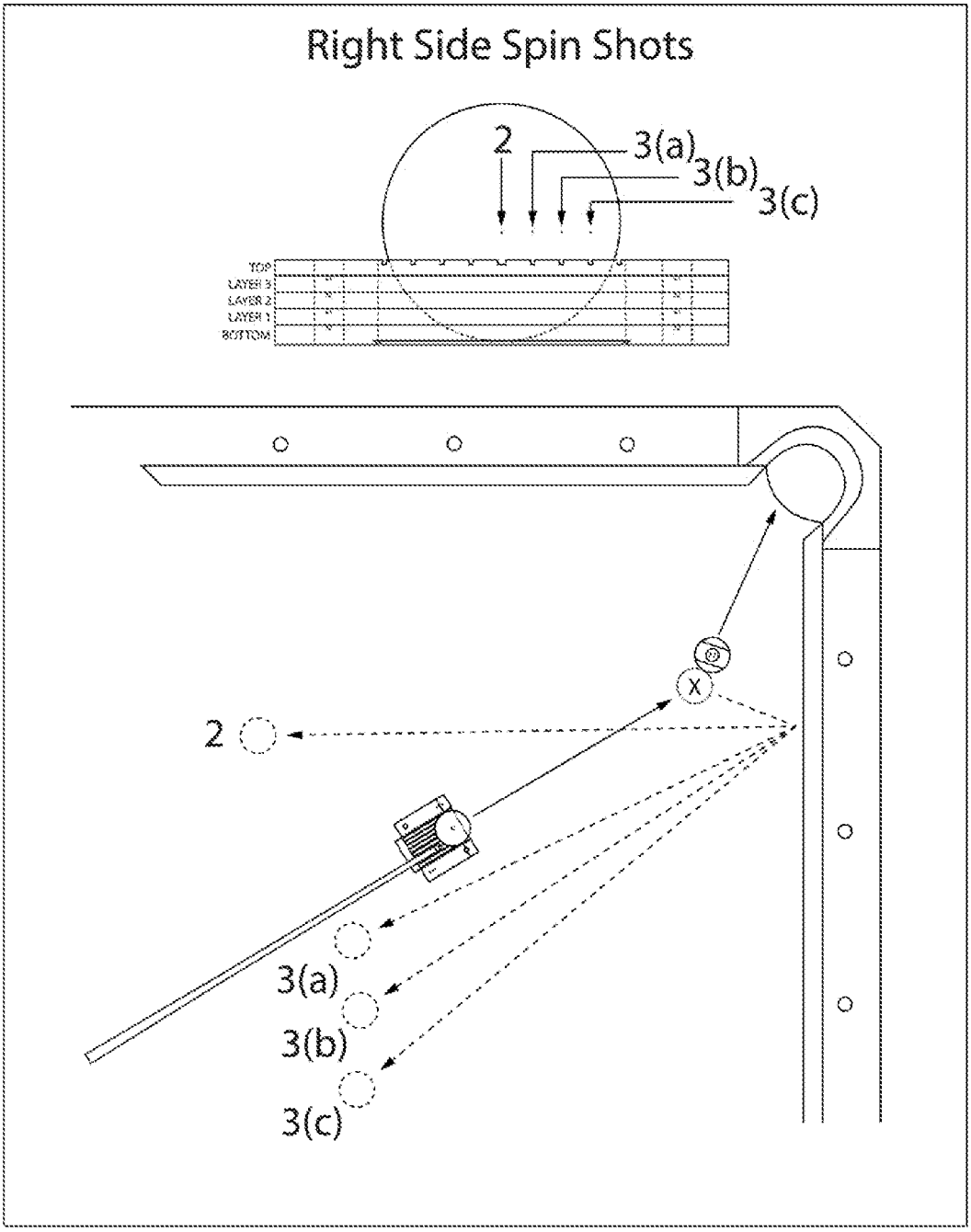
FIG. 14 shows a front view of the device when performing a Center Shot and Right Spin Shots and displaying the three right directions and the center sole direction. The bottom figure in FIG. 14 shows the position of the cue ball at the moment of impact on the target ball is represented by a dashed ball figure with a cross inserted. The trajectories and the final three right positions of the cue ball after striking the target ball are represented by three dashed lines and by three dashed cue ball figures respectively.

FIG. 14 shows the device prepared and displaying the different positions of the cue ball after impacting the target ball depending on the intensity of the right spins used. Rail represented in 3(*c*) makes the cue ball veer more right after hitting the cue ball then rail 3(*b*) and 3(*a*), and rail 3(*b*) makes the cue ball veer more right after impacting the target ball then rail 3(*a*). Accordingly, three right trajectories and three right final positions of the cue ball after impacting the target ball are represented by three dashed lines and three dashed cue ball FIGS. 3(*a*), 3(*b*) and 3(*c*). When the player uses the center line 2 of the device, the trajectory and the final position of the cue ball after impacting the target ball are represented by a dashed line and dashed cue ball FIG. 2.

FIG. 15 shows a cue ball displaying all points of contact in the cue ball when using the device, including the six different shots of Table 1 and the six different left and right spins and the center sole direction. The logical combination of six possible shots of Table 1 multiplied by the 7 spins (three left, one center and three right) throws 42 possible combinations. However, since the cue ball is a sphere object, some logical combinations are eliminated because they would produce miscues. Thus, the final number of possible shots is 36 and miscue points is 6. In FIG. 15 the number of the points are represented on the ball, and explained on the bottom of the FIG. 15. For explanatory purposes, the "X" point represents a "miscue", and "R" or "L" represents "Right" or "Left" respectively. The different numeration from 1 to 6 indicates the different six shots of Table 1 in that same order.

Figure 16:
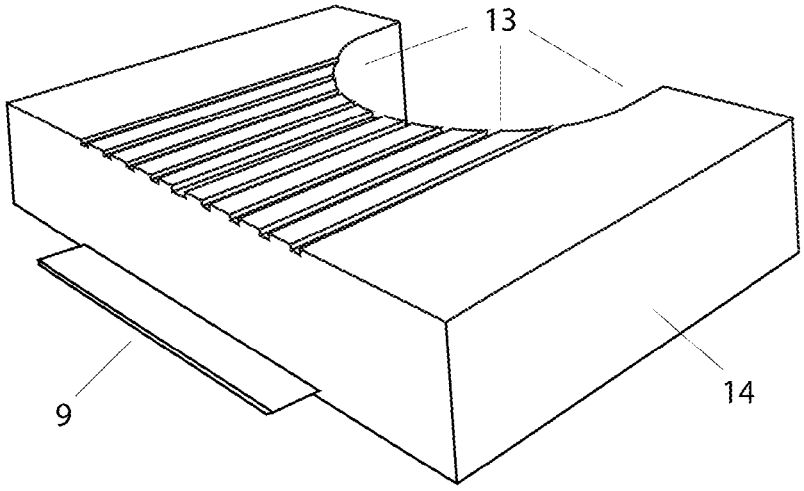
FIG. 16 shows the device in a sole piece embodiment.

FIG. 16 shows the device in a sole piece embodiment 14 containing the rail lines on the upper surface of the device and the Slider 9 at the bottom surface of the device to accommodate the cue ball in the correct position in the concave groove 13 of the device. FIG. 16 represents a sole piece which height can vary depending on the corresponding heights shown in Table of 3(b) in its third and fourth columns.

Although this invention has been described in detail with particular reference to the preferred embodiments, other embodiments can achieve almost the same results. Variations and modifications of the present invention will be considered obvious to those skilled in the art and it is intended to cover in the appended claims all such modifications and equivalents.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic (s), property(ies), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skill in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

To aid the Patent Office, and any readers of any patent issued on this application in interpreting the claims appended hereto, applicants wish to note that they do not intend any of the appended claims to invoke paragraph 6 of 35 U.S.C. § 112 as it exists on the date of filing hereof unless the words "means for" or "step for" are explicitly used in the particular claim.

For each of the claims, each dependent claim can depend both from the independent claim and from each of the prior dependent claims for each and every claim so long as the prior claim provides a proper antecedent basis for a claim term or element.

What is claimed is:

1. A billiards-training device for controlling a cue ball after striking a target ball including at least two stackable layers, the at least two stackable layers securely attachable to one another, wherein a height of the at least two stackable layers is selected from the group consisting of: 7 mm to 11 mm, 12 mm to 15 mm, 16 mm to 18 mm, 19 mm to 23 mm, 24 mm to 28 mm and 32 mm to 36 mm, the at least two stackable layers include a sliding panel mounted on a bottom layer of the at least two stackable layers;

wherein the sliding panel, allows a player to set the cue ball in a center of the sliding panel in order to use the device accurately.

2. The device of claim 1, wherein at least the two stackable layers are at least three, four, five, six, and seven stackable layers.

3. The device of claim 1, wherein an upper layer of the at least two stackable layers includes at least one of:

a center labeled line or groove on an upper surface of said at least two stackable layer for slidably receiving a cue stick;

one left, one center and one right labeled line or groove line on the upper surface of said at least two stackable layer for slidably receiving a cue stick;

two left, a center and two right labeled lines or groove on the upper surface of said at least two stackable layer for slidably receiving a cue stick;

three left, a center and three right labeled lines or groove on the upper surface of said at least two stackable layer for slidably receiving a cue stick; or four left, a center and four right labeled lines or groove lines on the upper surface of said at least two stackable layer for slidably receiving a cue stick.

4. The device of claim 3, wherein spacing distance between each of the labeled lines or grooves is selected from the group consisting of: 3 mm, 6 mm, 9 mm, 12 mm, 15 mm, 18 mm, 21 mm, 24 mm, 27 mm, and 30 mm.

5. The device of claim 1, wherein the height of the at least two stackable layers is selected from the group consisting of 9 mm, 13 mm, 17 mm, 21 mm, 26 mm, and 34 mm.

6. The device of claim 1, wherein the at least two stackable layers are connected to each other by a fastener selected from the group consisting of: magnet, securing knob, adhesive tape, hook and loop, and a combination thereof.

7. A billiards-training device for controlling a cue ball after striking a target ball comprising:

at least three stackable layers comprising a top layer, a middle layer, and a bottom layer, the at least three stackable layers securely attachable to one another, the at least three stackable layers include a sliding panel mounted on a bottom layer of the at least three stackable layers;

wherein the sliding panel, allows a player to set the cue ball in a center of the sliding panel in order to use the device accurately; and wherein, when stacked, the height of the combination of the top layer, middle layer and the bottom layer is selected from the group consisting of: 7 mm to 11 mm, 12 mm to 15 mm, 16 mm to 18 mm, 19 mm to 23 mm, 24 mm to 28 mm or 32 mm to 36 mm.

8. The device of claim 7, wherein the at least three stackable layers are at least four, five, six, and seven stackable layers.

9. The device of claim 7, wherein the height of the at least three stackable layers is selected from the group consisting of: 9 mm, 13 mm, 17 mm, 21 mm, 26 mm, and 34 mm.

10. The device of claim 7, wherein an upper layer of the at least three stackable layers includes at least one of:

a center labeled line or groove on an upper surface of said at least three stackable layer for slidably receiving a cue stick;

one left, one center and one right labeled line or grooves on the upper surface of said at least three stackable layer for slidably receiving a cue stick;

two left, a center and two right labeled line or grooves on the upper surface of said at least three stackable layer for slidably receiving a cue stick;

three left, a center and three right labeled lines or grooves on the upper surface of said at least three stackable layer for slidably receiving a cue stick; or four left, a center and four right labeled lines or grooves on the upper surface of said at least three stackable layer for slidably receiving a cue stick.

11. The device of claim 10, wherein spacing distance between each of the labeled lines or grooves is selected from the group consisting of 3 mm, 6 mm, 9 mm, 12 mm, 15 mm, 18 mm, 21 mm, 24 mm, 27 mm, 30 mm and a combination thereof.

12. The device of claim 7, wherein the at least three stackable layers are connected to each other by a fastener selected from the group consisting of: magnet, securing knob, adhesive tape, hook and loop, and a combination thereof.

13. The device of claim 7, wherein the at least three stackable layers comprises four or more stackable layers.

14. The device of claim 7, wherein the bottom-mounted sliding panel is mounted on a bottom layer in a dovetailed or half-dovetailed sliding joint.

15. A billiards-training device for controlling a cue ball after striking a target ball consisting essentially of a support with a height selected from the group consisting of: 9 mm, 13 mm, 17 mm, 21 mm, 26 mm, and 34 mm, said support characterized by having at least two stackable layers, the at least two stackable layers securely attachable to one another, wherein an upper surface of the at least two stackable layers includes at least one of:

a center labeled line or groove on an upper surface of said at least one stackable layer for slidably receiving a cue stick;

one left, one center and one right labeled line or groove on the upper surface of said at least one stackable layer for slidably receiving a cue stick;

two left, a center and two right labeled lines or grooves on the upper surface of said at least one stackable layer for slidably receiving a cue stick;

three left, a center and three right labeled lines or grooves on the upper surface of said at least one stackable layer for slidably receiving a cue stick; or four left, a center and four right labeled lines or grooves on the upper surface of said at least one stackable layer for slidably receiving a cue stick;

the at least two stackable layers include a sliding panel mounted on a bottom layer of the at least two stackable layers; and wherein the sliding panel, allows a player to set the cue ball in a center of the sliding panel in order to use the device accurately.

16. The device of claim 15, wherein the device has an overall height that ranges from 7 mm to 36 mm.

* * * * *